US007784888B2

(12) United States Patent
Oh et al.

(10) Patent No.: US 7,784,888 B2
(45) Date of Patent: Aug. 31, 2010

(54) REFRIGERATOR

(75) Inventors: Seung Hwan Oh, Gunpo-si (KR); Kyung Han Jeong, Seoul (KR); Sang Oh Kim, Seoul (KR); Myung Ryul Lee, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 338 days.

(21) Appl. No.: 11/235,366

(22) Filed: Sep. 27, 2005

(65) Prior Publication Data

US 2006/0087207 A1 Apr. 27, 2006

(30) Foreign Application Priority Data

Oct. 26, 2004 (KR) ..... 10-2004-0085688
Nov. 10, 2004 (KR) ..... 10-2004-0091365
Jun. 10, 2005 (KR) ..... 10-2005-0049831

(51) Int. Cl.
*A47B 81/00* (2006.01)
*A47B 97/00* (2006.01)

(52) U.S. Cl. ..... 312/223.6; 312/402

(58) Field of Classification Search ..... 312/273, 312/223.6, 402, 404; 174/DIG. 9, 57, 64, 174/69; 361/727, 826; 191/12 R; 362/133
See application file for complete search history.

(56) References Cited

U.S. PATENT DOCUMENTS 518,713 A * 4/1894 Connell ..... 362/133
1,497,728 A * 6/1924 Kresh ..... 362/133
1,532,935 A * 4/1925 Patton ..... 362/133
2,015,295 A * 9/1935 Steingruber ..... 219/218
2,861,857 A * 11/1958 Lee et al. ..... 312/312
2,882,382 A * 4/1959 Woxman ..... 219/452.13
3,270,253 A * 8/1966 Binder et al. ..... 361/726
4,814,571 A * 3/1989 Bowen et al. ..... 219/757
5,892,651 A * 4/1999 Arai ..... 361/221
6,042,244 A * 3/2000 Witkoski ..... 362/133
6,111,196 A * 8/2000 Arai ..... 174/50
7,021,308 B2 * 4/2006 Caruso ..... 126/211
2002/0171335 A1 * 11/2002 Held ..... 312/223.6
2005/0073225 A1 4/2005 Kwon et al.

FOREIGN PATENT DOCUMENTS

CN 1106527 A 8/1995
CN 2247784 Y 2/1997
JP 5-296647 A 11/1993
JP 2002-243354 A 8/2002
KR 1998-13821 U 6/1998
KR 10-0159711 B1 8/1998
KR 10-2003-0079552 A 10/2003
KR 10-2003-0088557 A 11/2003

OTHER PUBLICATIONS

English translation of Denpo, JP 05-296647.*

* cited by examiner

*Primary Examiner*—Darnell M Jayne
*Assistant Examiner*—Timothy M Ayres
(74) *Attorney, Agent, or Firm*—Birch, Stewart, Kolasch & Birch, LLP

(57) ABSTRACT

A refrigerator includes a body; a compartment within the body; a container within the compartment, the container being moveable along a first direction; an electrical device, the electrical device moving along with the container in the first direction when the container moves along the first direction; and a conductor for providing an electrical signal to the electrical device, the conductor being extendable and retractable in the first direction when the electrical device moves along the first direction.

14 Claims, 15 Drawing Sheets

REFRIGERATOR

This Nonprovisional application claims priority under 35 U.S.C. §119(a) on Patent Application No. 10-2004-0085688 filed in Korea on Oct. 26, 2004, Patent Application No. 10-2004-0091365 filed in Korea on Nov. 10, 2004, and Patent Application No. 10-2005-0049831 filed in Korea on Jun. 10, 2005, the entire contents of which are hereby incorporated by reference.

BACKGROUND OF THE INVENTION

1. Field of the Invention

The present invention relates to a refrigerator, and more particularly, to a mechanism electrically connecting a body of the refrigerator with an electrical device which is mounted on a door or a part of the refrigerator movable with respect to the body of the refrigerator.

2. Discussion of the Related Art

Conventional refrigerators are usually classified into three types, i.e., a top mount freezer type, a side by side type, and a bottom mount freezer type. In the top mount freezer type refrigerator, a freezing compartment is provided at an upper portion of the refrigerator and a refrigerating compartment is provided at a lower portion of the refrigerator. In the side by side type refrigerator, a freezing compartment and a refrigerating compartment are respectively arranged on a left portion and a right portion of a refrigerator. In the bottom mount freezer type refrigerator, a freezing compartment is provided at a lower portion of the refrigerator and a refrigerating compartment is provided at an upper portion of the refrigerator.

Electrical devices, such as a display panel, an ice and a water dispenser, etc., are usually provided on a door of a refrigerator. The electrical device is electrically connected with a body of the refrigerator by a cable. The cable supplies electrical power from a power source provided in the body of the refrigerator or sends a signal from a controller of the refrigerator and vice versa. The door and the body of the refrigerator are usually coupled by a hinge, and the cable is arranged to pass through the hinge in order to electrically connect the electrical device on the door and the body of the refrigerator.

Meanwhile, it is very uncomfortable for the user to use the freezing compartment mounted at the lower portion of the refrigerator when the door is simply open by rotating about the hinge because the user has to kneel and bend his or her body and stretch his/her hands into an inside of the freezing compartment mounted at the lower portion of the refrigerator.

SUMMARY OF THE INVENTION

Accordingly, the present invention is directed to a refrigerator that substantially obviates one or more problems due to limitations and disadvantages of the related art.

An object of the present invention is to provide a refrigerator which can elevate a compartment provided at a lower portion of the refrigerator when the door is open for the user's convenience and a mechanism for electrically connecting a device for elevating the compartment with the body.

The other object of the present invention is to provide a refrigerator having a mechanism which can electrically connect a body of the refrigerator with an electrical device mounted on a door coupled with the body without a hinge or mounted on a part of the refrigerator movable with respect to the body.

Another object of the present invention is to prevent a cable electrically connecting the electrical device with the body from being damaged by a movement of the door or other parts of the refrigerator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body having a compartment therein and a door opening and closing the compartment, an electrical device movable with respect to the body, and a conductor electrically connecting the electrical device with the body, wherein the conductor is extendable and retractable along a moving direction of the electrical device.

The electrical device may be movable forward or backward with respect to the body. The refrigerator may further include a container provided in the compartment, wherein the electrical device comprises an elevating device elevating the container.

In one embodiment, the conductor may include a first segment, and a second segment movable with respect to the first segment based upon the movement of the electrical device. The first and the second segments may be electrically connectable to or disconnectable from each other based upon the movement of the electrical device. The first and the second segments are overlappable with each other along a longitudinal direction of the conductor to shorten a length of the conductor. The first segment may be movable with respect to the second segment along a longitudinal direction of the conductor to lengthen or shorten a length of the conductor. The first segment may include a first terminal and the second segment may include a second terminal, wherein the first and the second terminals may be electrically connected when the door is open and may be electrically disconnected when the door is closed.

The refrigerator may further include a first rail and a second rail both for guiding a movement of the door. The conductor may include a first segment secured to the first rail, and a second segment secured to the second rail. The first and the second segments are electrically connectable to and disconnectable from each other based upon a movement of the door. The first segment may be arranged inside the first rail to be protected by the first rail and may have a first terminal exposed to an outside of the first rail to be contactable with the second segment. The second segment may be arranged on an outside surface of the second rail to prevent the second segment from being damaged by the first rail and may have a second terminal exposed to an inside of the second rail to be contactable with the first segment. The refrigerator may further include a protection cover secured to at least one of the rails to cover and protect a part of the conductor exposed to an outside of the rails.

The refrigerator in another aspect may further include a conductor guide extendable and retractable along a longitudinal direction thereof based upon the movement of the electrical device, wherein the conductor may be secured by the conductor guide. The conductor guide may include a first and a second guides overlappable with each other along a longitudinal direction of the conductor guide. The conductor may include a first segment secured to the first guide, and a second segment secured to the second guide, wherein the first and the second segments may be electrically connectable to and disconnectable from each other based upon a movement of the electrical device.

Alternatively, the conductor may include a flexible coiled portion extendable and retractable along a longitudinal direction thereof by its elasticity. The refrigerator may further include a supplemental conductor guide, wherein the conductor may be arranged to pass through the supplemental conductor guide to prevent the conductor from being slack. The conductor may be arranged to pass through the rails. The supplemental conductor guide may be provided in at least one of the rails. Alternatively, the supplemental conductor guide may be provided in the conductor guide.

Alternatively, the refrigerator may further include a foldable jointed cover, wherein the conductor may be arranged to pass through the foldable jointed cover. The foldable jointed cover may include a plurality of hollow segments coupled with each other by a pivot in series. A maximum angle, being able to be formed between two adjacent segments when the foldable jointed cover is fully unfolded, may be limited so as to prevent the foldable jointed cover from being slack.

The foldable jointed cover may include a first end secured to the body and a second end secured to the door. Alternatively, the refrigerator may further include a bracket secured to the door, and a first and a second rails secured to the bracket and the body, respectively, for guiding a movement of the door, wherein the jointed cover may have a first end secured to the bracket and a second end secured to the body.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
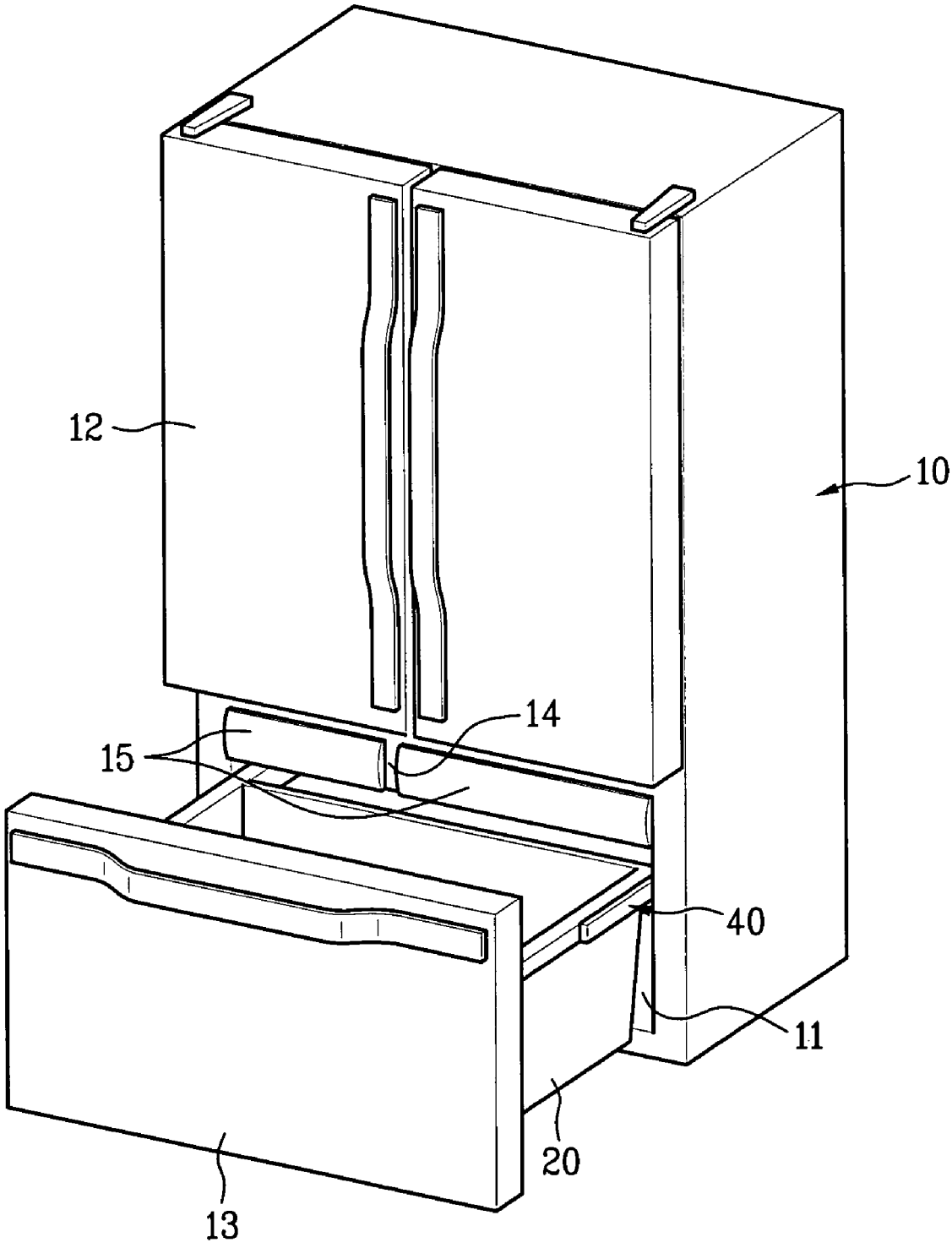
FIG. 1 illustrates a perspective view of a refrigerator according to an embodiment of the present invention.

Referring to FIG. 1, a refrigerator according to an embodiment of the present invention includes a body 10, compartments provided in the body 10, and doors 12 and 13 for opening and closing the compartments. The compartments, for example, include a refrigerating compartment (not shown) provided in an upper portion of the body 10 and a freezing compartment 11 provided in a lower portion of the body 10. Alternatively, it is possible that the refrigerating compartment is located in the lower portion of the body 10 and the freezing compartment is located in the upper portion of the body 10. A horizontal partition wall 14 divides an inside space of the body 10 into the refrigerating compartment and the freezing compartment 11. A mechanical component chamber 17 for accommodating a compressor, a condenser, etc. is provided in the lower portion of the body 10, especially at a rear side of the freezing compartment 11 as shown in FIG. 2.

A pair of doors 12 is coupled to the body 10 by a hinge. The doors 12 rotate about the hinge with respect to the body 10 for opening and closing the refrigerating compartment. The door 13 is provided at the lower portion of the body 10 for opening and closing the freezing compartment 11 at the lower portion of the body 10. The door 13 moves forward and backward with respect to the body 10 and the door 12 rotates about the hinge. Therefore, no hinge or pivot is necessary for the door 13 to be coupled with the body 10.

Figure 2:
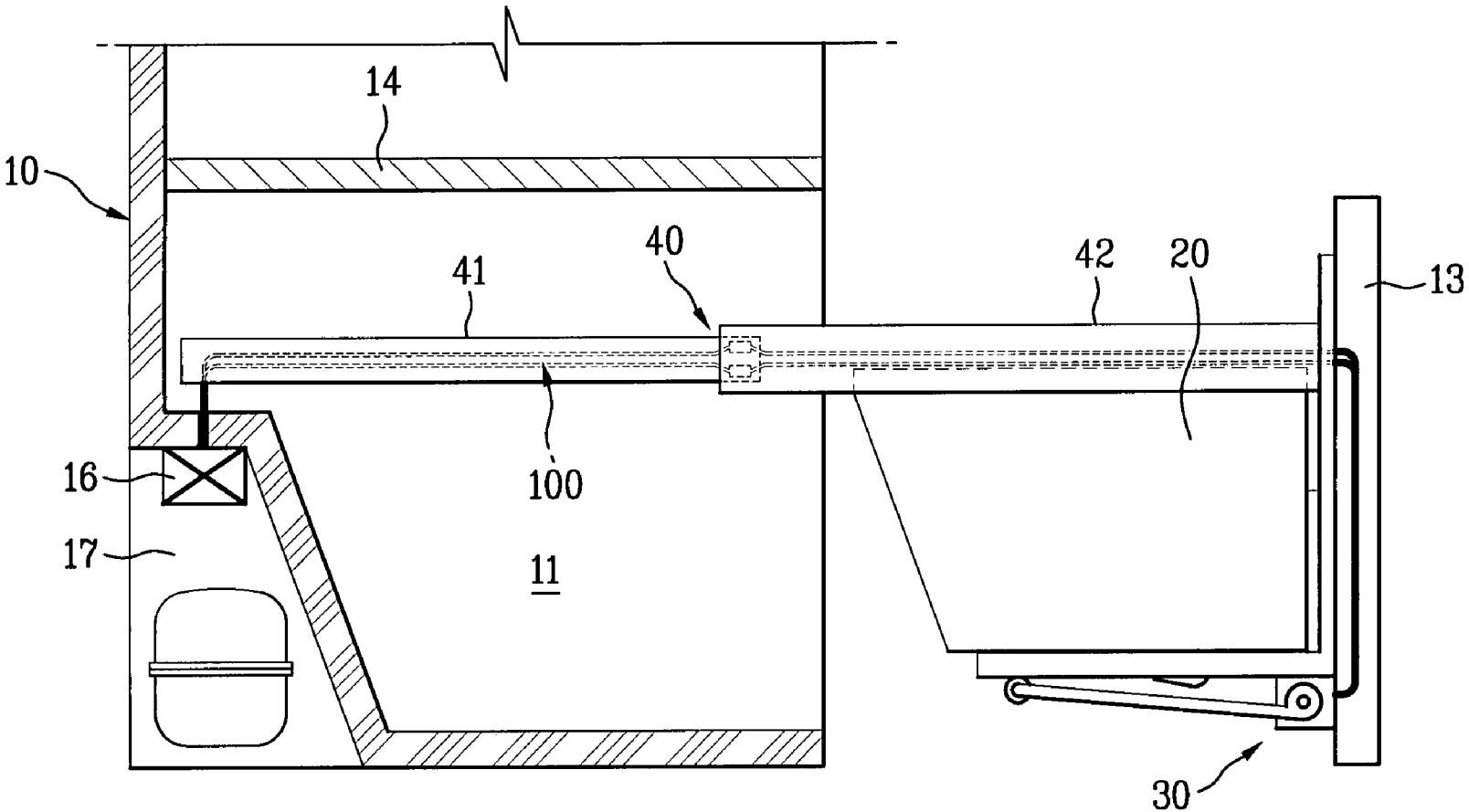
FIG. 2 illustrates a schematic cross-sectional view of a lower portion of the refrigerator shown in FIG. 1 for showing a conductor connection mechanism according to a first embodiment of the present invention.
Figure 12:
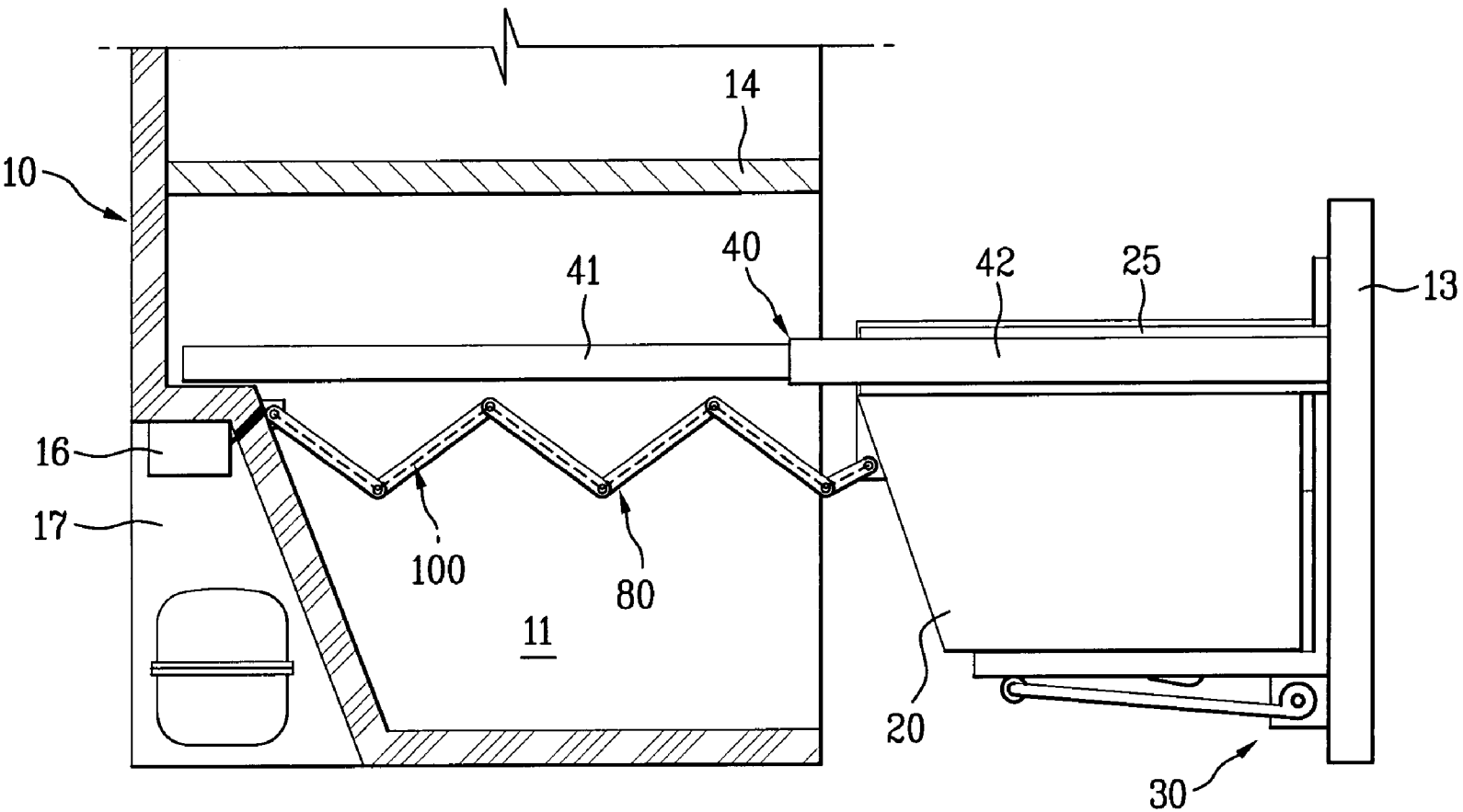
FIG. 12 illustrates a schematic cross-sectional view of the refrigerator shown in FIG. 11 for showing a conductor connection mechanism in accordance with the third embodiment of the present invention when a door is open.

A plurality of rails 40 are provided between the body 10 and the door 13 for smoothly guiding a sliding movement of the door 13 as shown in FIGS. 1 and 2. The rails 40 are arranged at both sides of the door 13, and include a first rail 41 secured to the body 10 and a second rail 42 secured to a backside of the door 13. Alternatively, a bracket 25 firmly secured to the backside of the door 13 may be provided and the second rail 42 may be secured to the bracket 25 as shown in FIG. 12.

Figure 5:
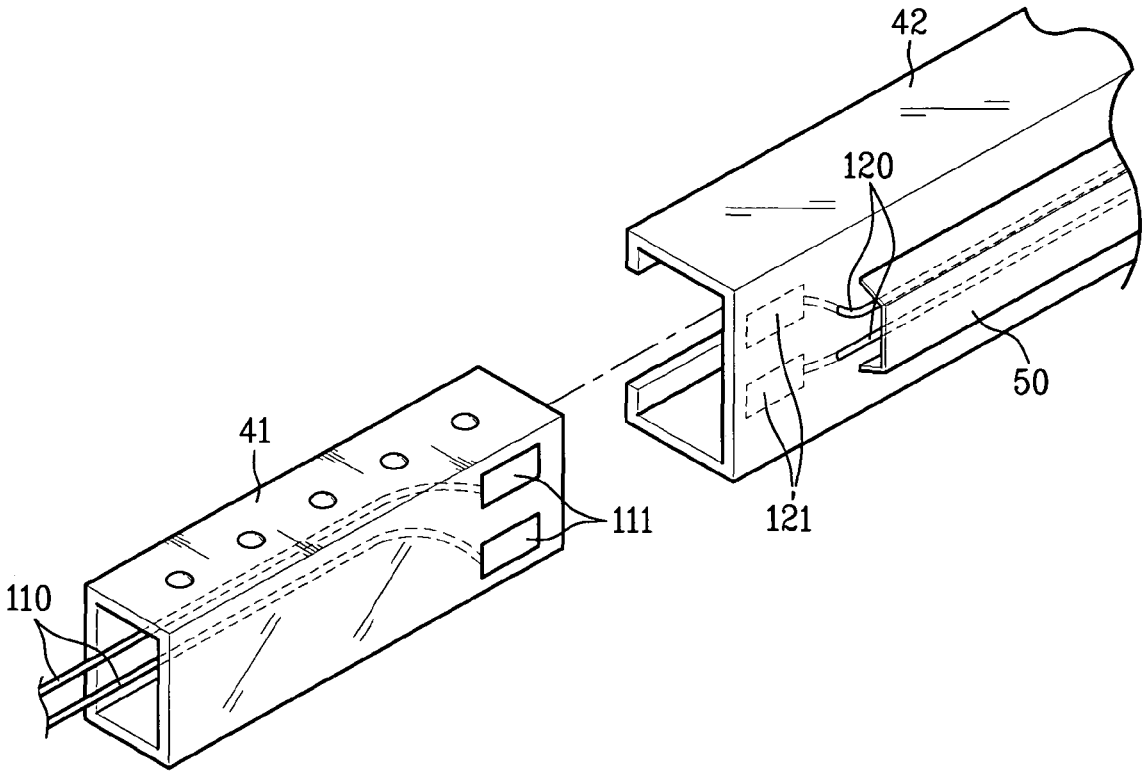
FIG. 5 illustrates a partial exploded view of rails to which the conductor in accordance with the first embodiment of the present invention is secured.
Figure 6:
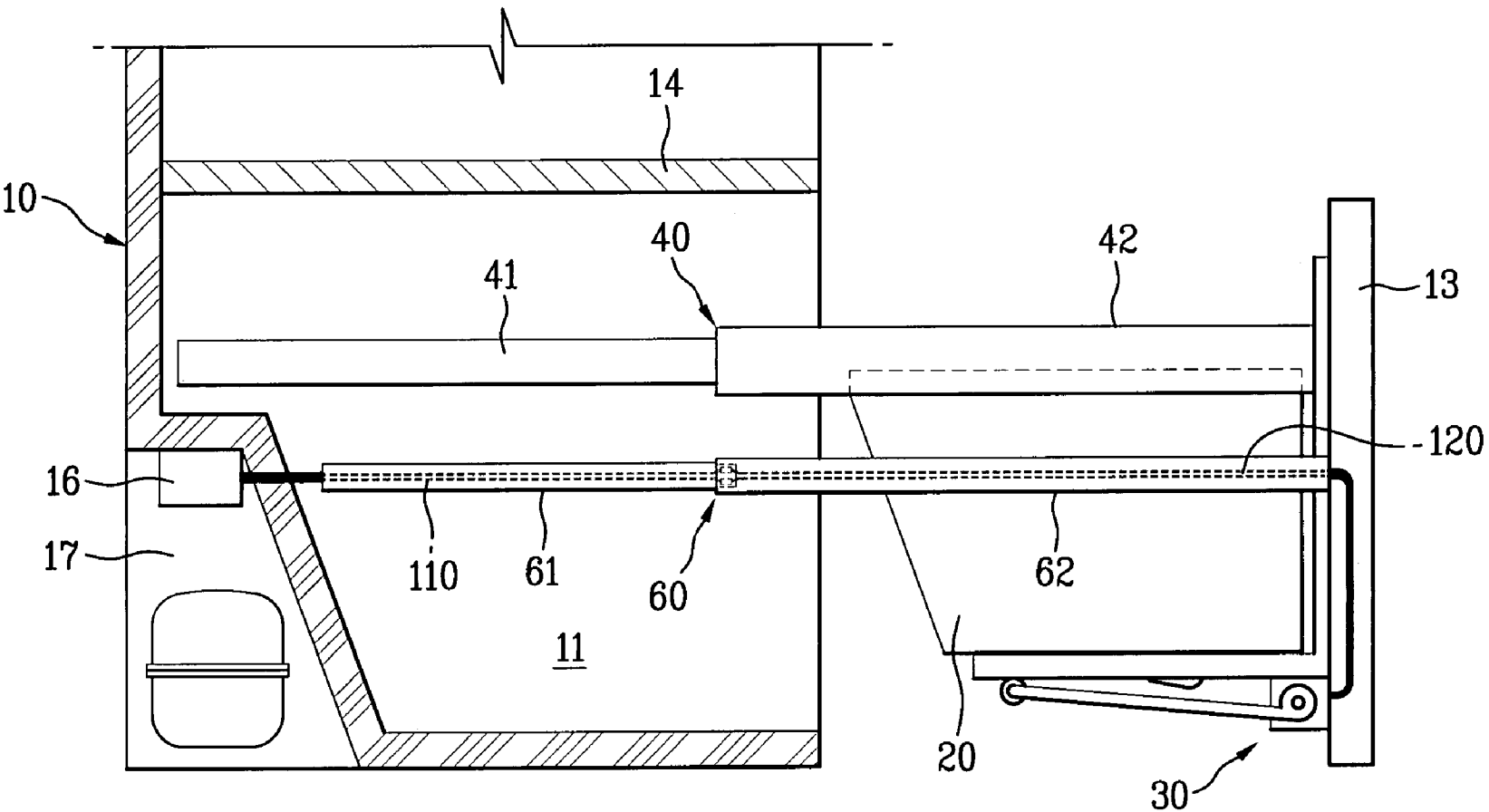
FIG. 6 illustrates a schematic cross-sectional view of the lower portion of the refrigerator shown in FIG. 1 for showing a variation of the conductor connection mechanism in accordance with the first embodiment of the present invention.

The first rail 41 is able to move with respect to the second rail 42 by sliding and vice versa. For a smooth sliding of the first and the second rails 41 and 42, a plurality of balls or rollers may be provided between the first and the second rails 41 and 42. The first rail 41 may be arranged on the second rail 42 and vice versa. Alternatively, the first rail 41 may be inserted into the second rail 42 as shown in FIG. 5 and vice versa. Meanwhile, the rails 40 may include three or more than three rails connected to each other.

Figure 3:
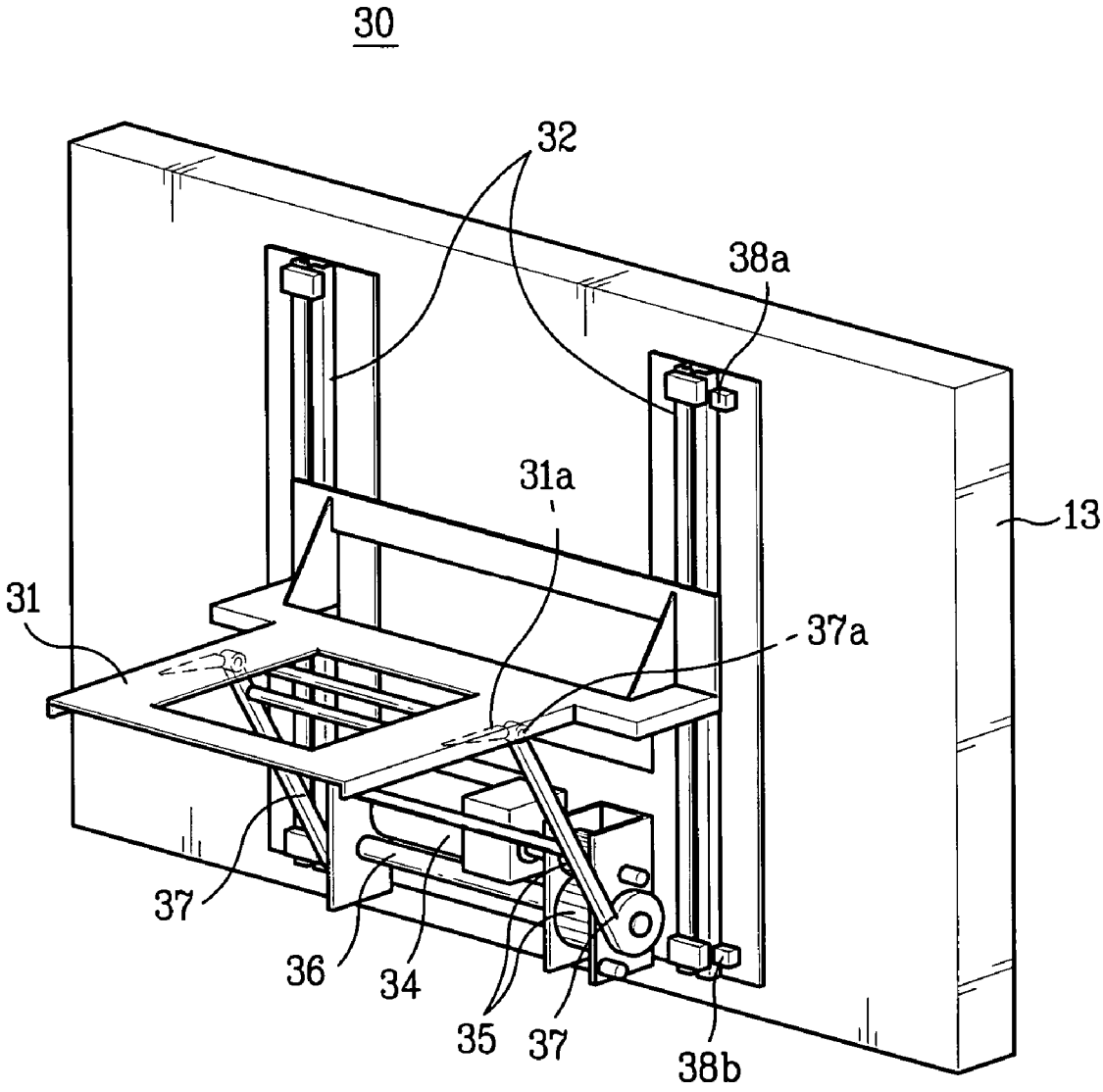
FIG. 3 illustrates a perspective view of an elevating device mounted on a door of the refrigerator shown in FIG. 1.

At least one container 20 for storing food therein is provided in the freezing compartment 11 at a lower portion of the freezing compartment 11 as shown in FIGS. 1 and 2, and at least one drawer 15 is provided above the container 20 in the freezing compartment 11 as shown in FIG. 1. The container 20 moves forward and backward with respect to the body 10 along with a movement of the door 13 while the drawer 15 is movably independent of the movement of the door 13. For the user's convenience, the container 20 may be automatically elevated when the door 13 is fully open. In an embodiment, an elevating device 30 is provided to the refrigerator as shown in FIGS. 2 and 3. The elevating device is secured to a rear surface of the door 13 and the container 20 is seated on and supported by the elevating device 20.

FIG. 3 illustrates a mechanism of the elevating device 30 in detail. The detailed mechanism of the elevating device 30 will be described referring to FIG. 3. As shown in FIG. 3, the elevating device 30 includes a lifter 31 on which the container 20 is seated, a pair of elevating rails 32 secured to the door 13 for guiding an elevating movement of the lifter 31, and a driving unit for automatically elevating the lifter 31.

The lifter 31, for example, has an "L" shaped bent form. A vertical portion of the lifter 31 is coupled with the pair of elevating rails 32 vertically secured to the backside of the door 13 and a horizontal portion of the lifer 31 supports the container 20 seated thereon. The lifter 31 moves upward and downward along the elevating rails 32 by the driving unit when the door 13 is open.

The driving unit includes at least one arm 37 rotatable with respect to the door 13, a motor 34, a gear assembly 35 coupled with a shaft of the motor 34, a driving shaft 36 coupled with the gear assembly 35 and the arm 37 to rotate the arm 37. In the illustrated embodiment, there are two arms 37 arranged at both sides of a lower portion of the rear of the door 13. The motor 33 is secured to the backside of the door 13 and arranged between the two arms 37. The motor 34 is controlled by a controller (not shown) of the refrigerator or by a sub controller (not shown) for operating the motor 34 independently from the controller.

A roller 37*a* is provided at an end of the arm 37 to support a bottom surface of the lifter 31. The roller 37*a* rolls forward and backward on the bottom surface of the lifter 31 when the arm 37 is rotated by the motor 34. A slant projection 31*a* is provided on the bottom of the lifter 31 as shown in FIG. 3 and the roller 37*a* rolls over the projection 31*a*when the lifter 31 is fully elevated. Therefore, it can prevent the lifter 31, when fully elevated, from falling downward even if the motor 34 stops because the roller 37*a* is supported by the projection 31*a*.

There are an upper sensor 38*a* on top of the elevating rail 32 and a lower sensor 38*b* on bottom of the elevating rail 32. The upper sensor 38*a* and the lower sensor 38*b* detect the lifter 31 at the top or the bottom of the elevating rail 32, respectively, and send a signal to the controller. After receiving the signal, the controller stops the motor 34. Therefore, a movement range of the lifter 31 is limited and it would prevent the lifter 31 from being derailed from the elevating rail 32. Alternatively, there may be an upper limit switch (not shown) on the top of the elevating rail 32 and a lower limit switch (not shown) on the bottom of the elevating rail 32. The upper limit switch and the lower limit switch can directly stop the motor 34 by cutting off the power supplied to the motor 34.

In an embodiment, the lifter 31 is automatically elevated as soon as the door 13 is fully open or after the door 13 is fully open for a predetermined time passes, and the fully lifted lifter 31 automatically moves downward as soon as the door 13 is slightly pushed to be closed. Alternatively, a control button (not shown) may be provided on the doors 12 or 13 in order that the user can control the elevating device 30 by pushing the control button.

When the control button is pushed or a predetermined time passes after the door 13 is fully open, the motor 34 starts to work. Then, the gear assembly 35 runs by the motor 34 to rotate the driving shaft 36. As the driving shaft 36 is rotated, the arm 37 is getting rotated and the roller 37*a* at the end of the arm 37 is getting raised while rolling on the bottom of the lifter 37. Therefore, the lifter 31 is also getting raised along with the container 20 which is seated on the lifter 31. When the lifter 31 is fully lifted, the upper sensor 38*a* detects the lifter 31 and sends a signal to the controller. After receiving the signal, the controller stops the motor 34 and therefore stops an elevating movement of the lifter 31. At this time, the roller 37*a* at the end of the arm 37 is engaged with and supported by one side of the slant projection 31*a*. Therefore, the reverse movement of the arm 37 and the downward movement of the lifter 31 along with the container 20 due to the gravity can be effectively prevented.

Meanwhile, after taking the food out of the container 20 or putting new food into the container 20, the user pushes the control button or slightly pushes the door 13 towards the body 10 of the refrigerator. Then, the motor 34 reversely rotates its shaft. Therefore, the lifter 31 and the container 20 move downward together. In case that the lifter 31 and the container 20 fully come down, the lower sensor 38*b* and the controller stop a downward movement of the lifter 31. Then, the user can put the container 20 into the freezing compartment 11 by pushing the door 13 toward the body 10.

As mentioned above, the elevating device 30 movable with respect to the body 10 of the refrigerator along with the door 13 is supplied power from a power source 16 (shown in FIG. 2) in the body 10 of the refrigerator. Alternatively, it is possible that the other electrical devices, such as a display panel or a touch panel, etc., provided on the door 13 may need the electrical power. Further, it is also possible that another electrical device, such as a sensor, etc., communicating with the controller to send a signal, may be provided on the door 13. In these cases, it is necessary that the electrical devices movable with respect to the body 10 be connected with at least one of the power source 16 and the controller in the body 10 by a conductor such as a power cable or a signal cable.

An embodiment of the present invention provides a conductor 100 to electrically connect the electrical device movable with respect to the body 10 with the power source 16 or the controller in the body 10. The conductor 100 includes at least one of the power cable, the signal cable, and other types of wiring connection. The conductor 100 is extendable and retractable in a first direction when the electrical device moves along the first direction or along the movement of the door 13 in the first direction in order to prevent the conductor 100 from being slack and damaged by other parts of the refrigerator. In the illustrated embodiments, the first direction is a horizontal direction. However, the present invention can also applies to a conductor extendable and retractable in a vertical direction or other directions. A various embodiments of the conductor 100 and their variations are shown in FIGS. 2, and 4A to 15B. All embodiments and their variations of the conductor 100 will be described in detail referring to the drawings corresponding to each embodiment and its variations.

A first embodiment of the conductor 100 is illustrated in FIGS. 2, and 4A to 5 in detail. As shown in the above drawings, the conductor 100 according to the first embodiment includes a first segment 110, and a second segment 120 movable with respect to the first segment 110. The first segment 110 and the second segment 120 are electrically connectable to and disconnectable from each other based upon the movement of the electrical devices. The first segment 110 and the second segment 120 both include an anode cable and a cathode cable, respectively.

Figure 4A:
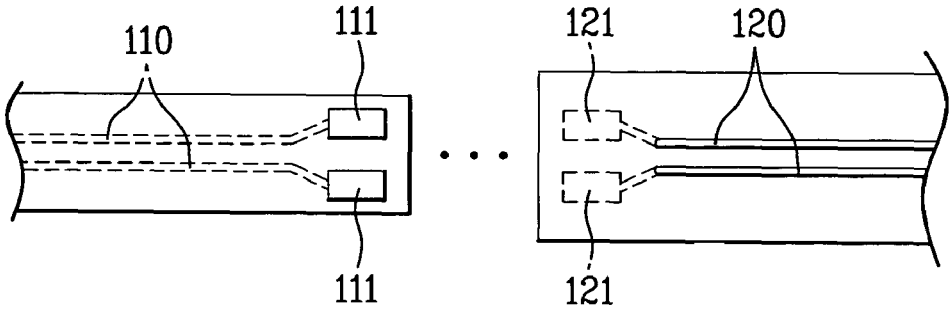
FIGS. 4A to 4C illustrate diagrams showing the conductor connection mechanism shown in FIG. 2 in detail, respectively.
Figure 4B:
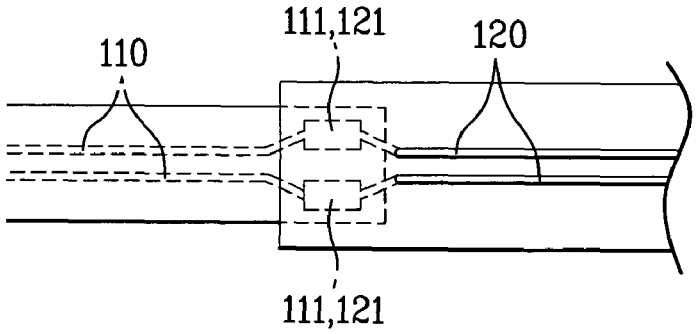
Figure 4C:
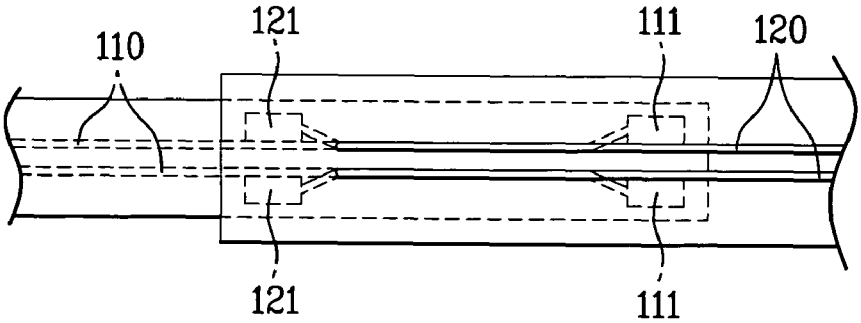

The first segment 110 has a first end connected with the power source 16 in the body 10 and a second end opposite to the first end. The second segment 120 has a first end connected with the electrical device, for example, the elevating device 30, and a second end opposite to the first end. The second end of the first segment 110 and the second end of the second segment 120 are connectable with each other when the door 13 is open and disconnectable when the door is closed. In the illustrated embodiment, a first terminal 111 is provided at the second end of the first segment 110 and a second terminal 121 is provided at the second end of the second segment 120 as shown in FIGS. 4A to 4C.

In an embodiment, the first segment 110 is secured to the body 10 and non-movable with respect to the body 10 and the second segment 120 is secured to the electrical device, for example, the elevating device 30, or the door 13. While the first segment 110 is non-movable with respect to the body 10, the second segment 120 can be movable forward and backward with respect to the body 10 along with the movement of the electrical devices or the movement of the door 13. The second segment 120 may be secured to the door 13 or a rigid supporter firmly secured to the door 13.

The first segment 110 and the second segment 120 are overlapped with each other to shorten a longitudinal length of the conductor 100 when the door 13 closes the freezing compartment 11. At this time, the first terminal 111 and the second terminals 121 are disconnected from each other as shown in FIG. 4C. Therefore, the electrical power from the power source 16 in the body 10 cannot be supplied to the electrical device, e.g., the elevating device 30, when the door 13 is closed.

On the other hand, as the door 13 is moving forward with respect to the body 10 to open the freezing compartment 11, the first and the second terminals 111 and 121 are getting closer with each other while the longitudinal length of the conductor 100 is getting longer. Eventually, the first and the second terminals 111 and 121 are electrically connected with each other as shown in FIG. 4B and the length of the conductor 100 is maximized when the door 13 is fully open. Therefore, the electrical power from the power source 16 can be supplied to the electrical device, e.g., the elevating device 30, when the door 13 is open.

Alternatively, the first segment 110 and the second segment 120 are secured to the first rail 41 and the second rail 42, respectively, as shown in FIG. 5. Since the second rail 42 is movable with respect to the first rail 41 along with the movement of the door 13, the second segment 120 is also movable with respect to the first segment 110 along with the movement of the door 13.

The first rail 41 may have a pillar shape, for example, a hollow square pillar shape as shown in FIG. The first segment 110 may be arranged inside the first rail 41 in order that the first segment 110 is protected by the first rail 41. The first segment 110 may be firmly secured to an inner surface of the first rail 41 in order not to be slack due to the gravity. While the first segment 110 is arranged in the first rail 41, the first terminal 111 at the end of the first rail 41 is provided on an outer surface of the first rail 41 as shown in FIG. 5. Since the first terminal 111 is exposed at an outside of the first rail 41, the first terminal 111 can be contacted with the second segment 120.

The first rail 41 can be inserted into the second rail 42 along a longitudinal direction of the second rail 42 and the second segment 120 is arranged outside the second rail 42 in order that the second segment 120 can be prevented from being damaged by the first rail 41. The second segment 120 may be firmly secured on an outer surface of the second rail 42 in order not to be slack. While the second segment 120 is arranged on the outer surface of the second rail 42, the second terminal 121 is arranged on an inner surface of the second rail 42 facing the first rail 41. Therefore, the second terminal 121 on the inner surface of the second rail 42 is contactable with the first terminal 111 on the outside surface of the first rail 41.

As mentioned above, the second segment 120 of the conductor 100 is arranged outside the second rail 42 while the first segment 110 is arranged inside the first rail 41. In order to protect the exposed second segment 120, a protection cover 50 is provided as shown in FIG. 5. The protection cover 50 is secured to the outer surface of the second rail 42 and the second segment 120 is arranged between the second rail 42 and the protection cover 50.

Alternatively, the second rail 42 may have a square pillar and the second segment 120 may be arranged inside the second rail 41. In this case, the first rail 41 may be insertable into the second rail 42, and the first segment 110 may be arranged outside the first rail 41. Further, the protection cover 50 may be secured to the first rail 41. As mentioned above, the protection cover 50 may be secured to any of the first rail 41 and the second rail 42 in order to protect a part of the conductor 100 exposed at the outside of the rails 41 and 42.

In operation, the first and the second rails 41 and 42 are overlapped with each other when the door 13 is closed as shown in FIG. 4C. At this time, the first and the second terminals 111 and 121 respectively secured to the first rail 41 and the second rail 42 are disconnected from each other, thereby the electrical power from the power source 16 in the body 10 cannot be supplied to the electrical device, e.g., the elevating device 30

On the other hand, the first and the second rails 41 and 42 are lengthened when the door 13 is open. Therefore, the first and the second terminals 111 and 121 respectively secured to the first rail 41 and the second rail 42 are connected with each other. Therefore, the electrical power from the power source 16 in the body 10 can be supplied to the electrical device, e.g., the elevating device 30.

Therefore, in the first embodiment, the rails 41 and 42 work both as rails for guiding the container 20 and as conductor guides.

Figure 9:
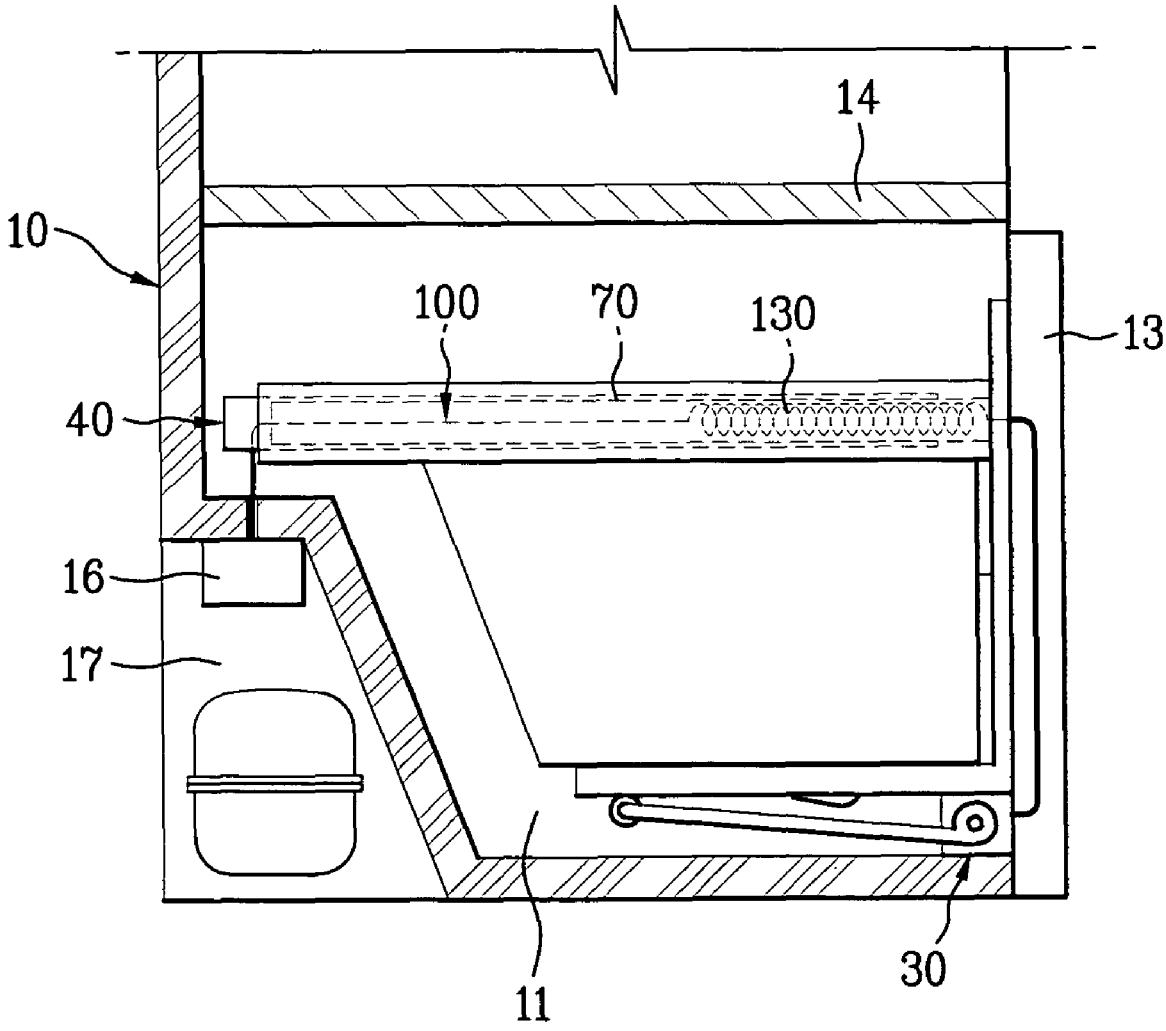
FIG. 9 illustrates a schematic cross-sectional view of the lower portion of the refrigerator shown in FIG. 7 for showing a conductor connection mechanism in accordance with a second embodiment of the present invention when the door is closed.

A variation of the refrigerator according to the first embodiment of the present invention is illustrated in FIG. 9. As shown in FIG. 9, a conductor guide 60, independent from the rails 41 and 42, is provided to the variation of the refrigerator according to the first embodiment. The conductor guide 60 is extendable and retractable along a longitudinal direction thereof based upon the movement of the electrical part, e.g., the elevating device 30, or the movement of the door 30.

The conductor guide 60 includes a first guide 61 secured to the body 10 of the refrigerator and a second guide 62 secured to the door 13 directly or a supporter firmly secured to the door 13. The first guide 61 is overlapped with the second guide 62 when the door 13 is closed by being inserted into the second guide 62 along a longitudinal direction of the second guide 62 and vice versa. Therefore, the conductor guide 60 is extendable and retractable along a longitudinal direction thereof by means of a relative movement of the first and the second guides 61 and 62 based upon the movement of the electrical device or the door 13. These mechanisms are very similar to those of the first and the second rails 41 and 42. Therefore more detailed descriptions about the structure of the conductor guide 60 will be omitted.

In the variation of the first embodiment of the present invention, the conductor 100 also includes the first segment 110 secured to the first guide 61 and the second segment 120 secured to the second guide 62 as shown in FIG. 9. The first and the second segments 110 and 120 are electrically connectable to and disconnectable from each other based upon the movement of the electrical device, e.g., the elevating device 30, or the movement of the door 13. In an embodiment, the first and the second segments 110 and 120 have a terminal at an end thereof, respectively.

In addition, the first segment 110 may be arranged inside the first guide 61 and the second segment 120 may be arranged outside the second guide 62 and vice versa. A protection cover (not shown in FIG. 9) can be secured to at least one of the first and the second segment 110 and 120 in order to protect an exposed part of the conductor 100. These mechanisms are very similar to those described above referring to FIGS. 4A to 8. Therefore more detailed descriptions about the structure of conductor guide 60 and the conductor 100 will be omitted.

In the variation of the first embodiment of the present invention, the forward and backward movement of the door 13 with respect to the body 10 in order to open and close the freezing compartment 11 is smoothly guided by the first and the second rails 41 and 42 while the stable relative movement of the first and the second segments 110 and 120 are guided by the first and the second guides 61 and 62. Of course, the first and the second segments 110 and 120 are connected with each other when the door 13 is open and are disconnected from each other when the door 13 is closed. Meanwhile, the conductor guide 60 may include three or more than three guides connected with each other.

Figure 7:
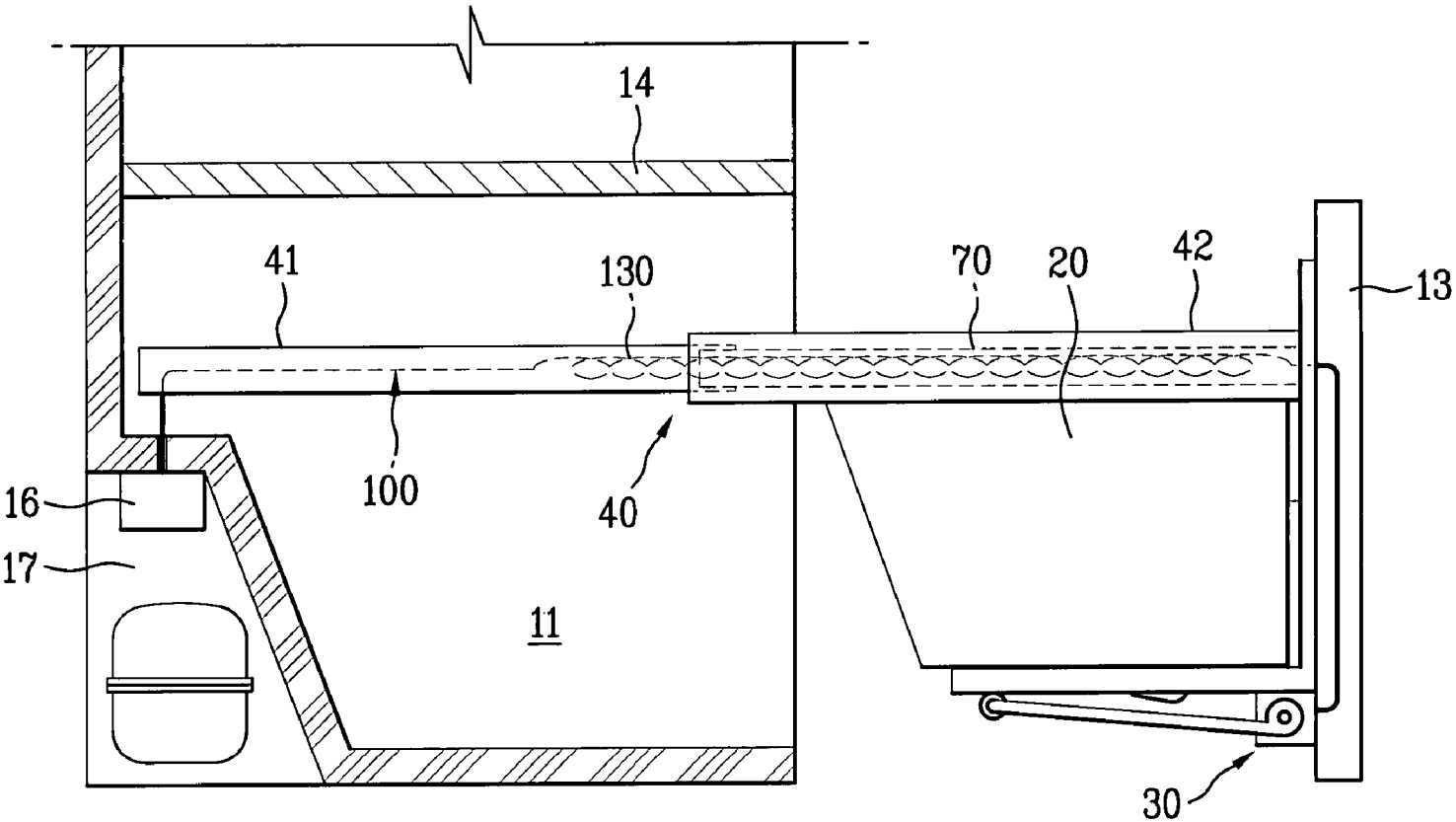
FIG. 7 illustrates a schematic cross-sectional view of the lower portion of the refrigerator shown in FIG. 1 for showing a conductor connection mechanism in accordance with a second embodiment of the present invention when the door is open.
Figure 8:
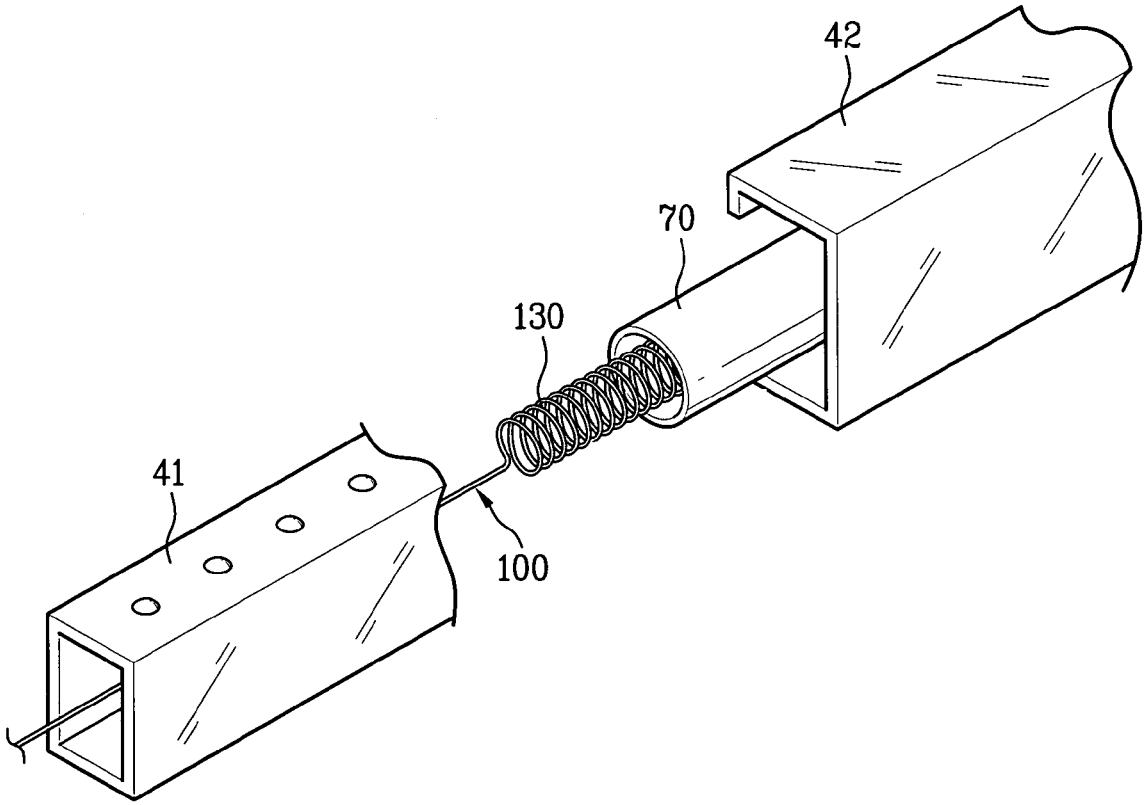
FIG. 8 illustrates a partial exploded view of rails and a supplemental cable guide through which the cable in accordance with the second embodiment of the present invention passes.

A second embodiment of the conductor 100 is illustrated in FIGS. 7 to 9 and will be described in detail. The conductor 100 according to the second embodiment includes a flexible coiled portion 130 extendable and retractable along a longitudinal direction thereof by its elasticity.

The coiled portion 130 is extendable along a longitudinal direction thereof in order to lengthen a total horizontal length of the conductor 100 when a tensile force is supplied to the conductor 100. On the other hand, the extended coiled portion 130 is retractable along a longitudinal direction thereof in order to shorten a total horizontal length of the conductor 100 when the tensile force supplied thereto is removed. A first end of the conductor 100 is secured to the power source 16 or the controller in the body 100 and a second end of the conductor 100 is secured to the electrical device, e.g., the elevating device 30. When the door 13 is open, the tensile force is supplied to the conductor 100. Therefore, the total horizontal length of the conductor 100 is maximized due to an extension of the coiled portion 130. On the other hand, when the door 13 is closed, the tensile force supplied to the conductor 100 is removed. Therefore, the total horizontal length of the conductor 100 is minimized due to a retraction of the coiled portion 130 by its elasticity.

The coiled portion 130 may be formed throughout most of the entire length of the conductor 100. However, the conductor 100 is likely to be slack when retracted by the gravity in this case. Therefore, the coiled portion 130 can be a portion of the conductor 100 in order to prevent the conductor 100 from being slack by the gravity when retracted. In addition, a supplemental conductor guide 70 may be provided to prevent the conductor 100 from being slack by the gravity and being damaged by other parts of the refrigerator. The supplemental conductor guide 70 may be in a tube shape and the conductor 100, especially the coiled portion 130, is arranged in or to pass through the supplemental conductor guide 70 as shown in FIG. 8.

The supplemental conductor guide 70 is arranged along a direction of the movement of the door 13. A minimum length of the supplemental conductor guide 70 can be set so that the supplemental conductor guide 70 may sufficiently accommodate the fully retracted coiled portion 130 therein in order to prevent the retracted coiled portion 130 from being slack by the gravity as shown in FIG. 9. In addition, a maximum length of the supplemental conductor guide 70 can be set so that the supplemental conductor guide 70 may be prevented from being crashed into the body 10 when the door 13 is fully closed as shown in FIG. 9.

The supplemental conductor guide 70 is arranged in the rails 41 and 42, more particularly, in the second rail 42 in the illustrated embodiment as shown in FIGS. 7 and 8. The supplemental conductor guide 70 is secured to the door 13 directly or other parts firmly secured to the door 13. Alternatively, the supplemental conductor guide 70 is secured to the second rail 42 directly. Therefore, the supplemental conductor guide 70 is movable with respect to the body 10 and the first rail 41 along with the movement of the second rail 42 and the door 13.

Figure 10:
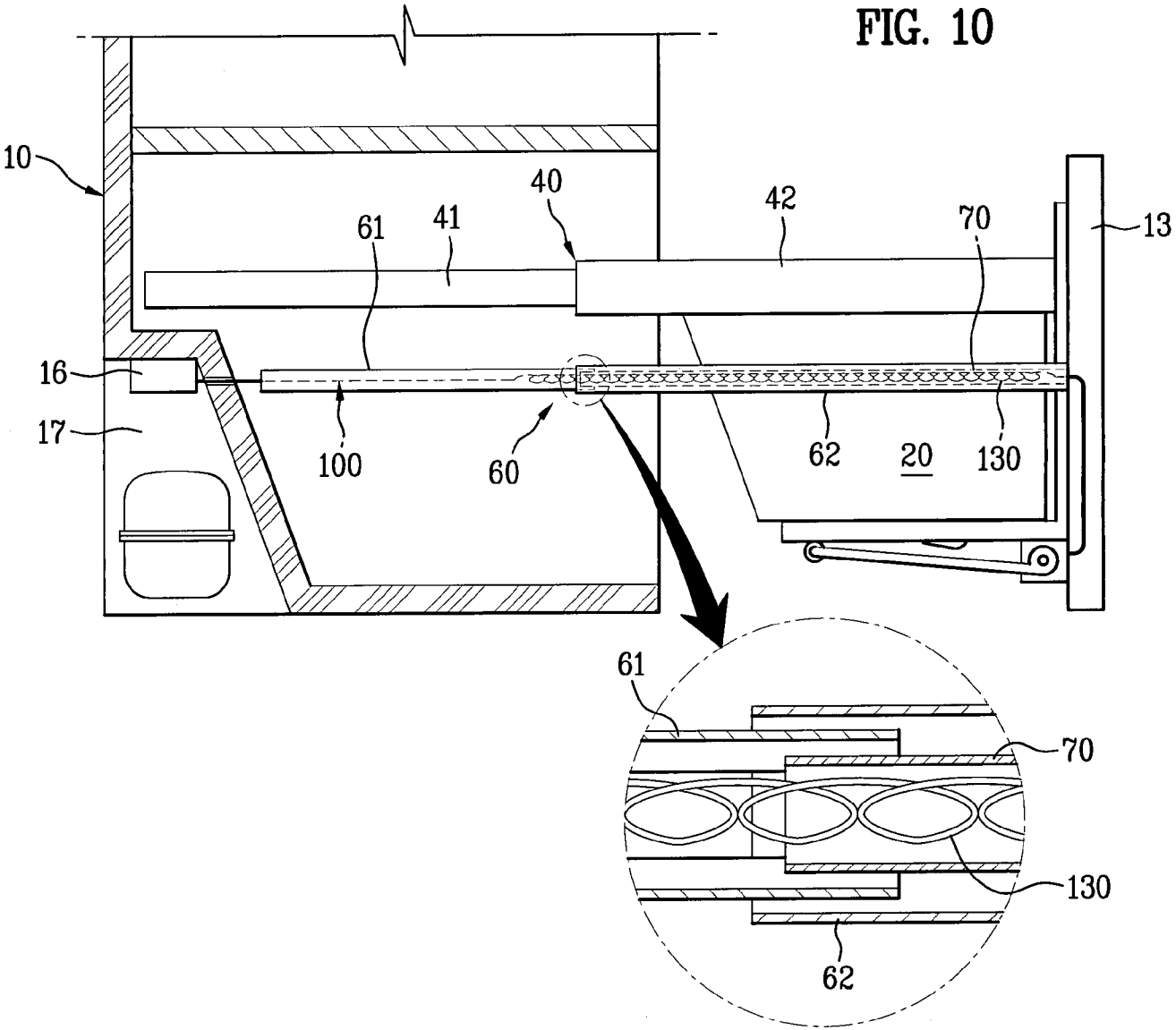
FIG. 10 illustrates a schematic cross-sectional view of the lower portion of the refrigerator shown in FIG. 1 for showing a variation of the second embodiment of the present invention.
Figure 11:
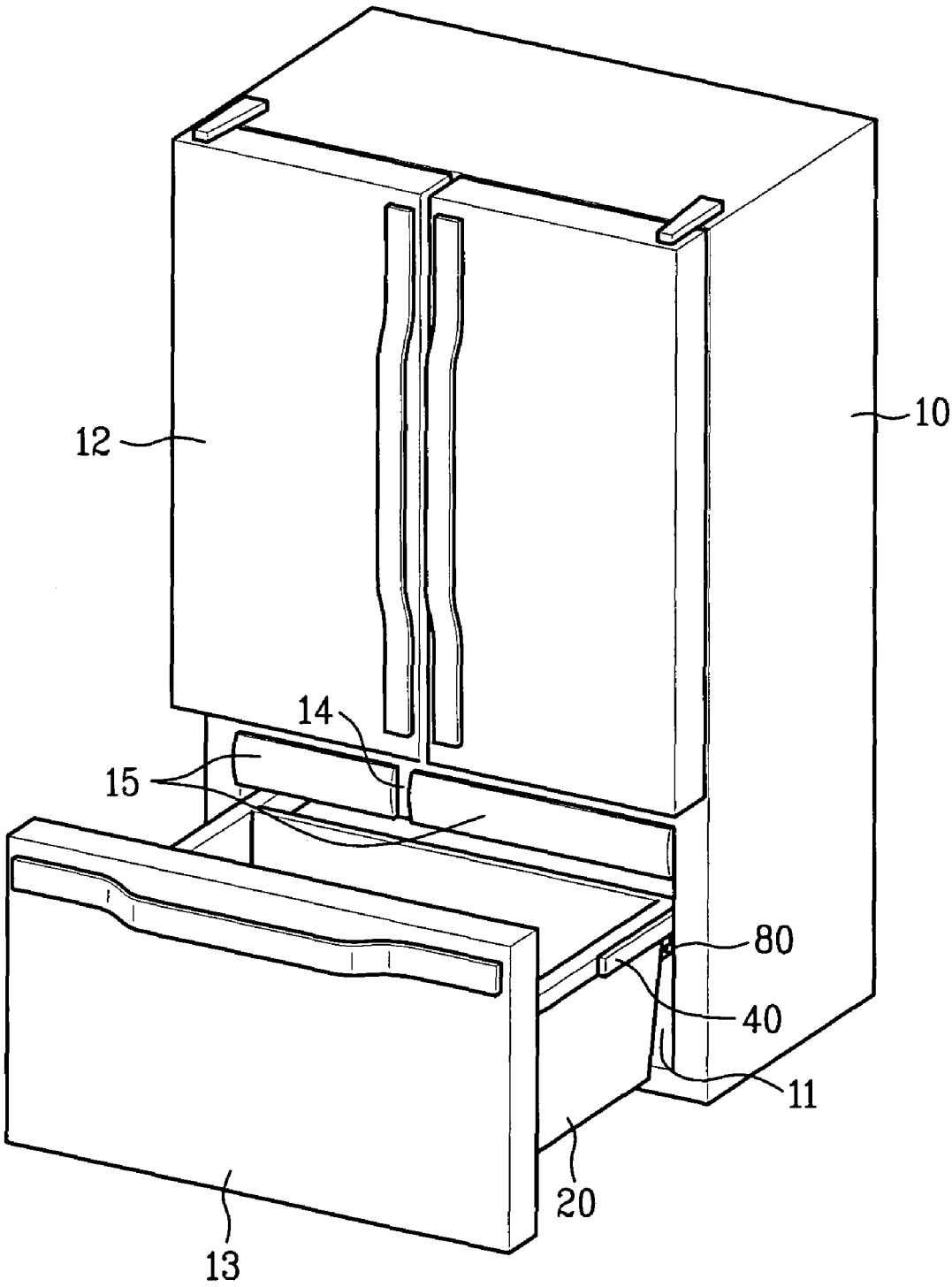
FIG. 11 illustrates a perspective view of a refrigerator in accordance with a third embodiment of the present invention.

Alternatively, the conductor 100 having the coiled portion 130 may be arranged in or to pass through the conductor guide 60 independent from the rail 40 as shown in FIG. 10 as a variation of the second embodiment. In addition, the supplemental conductor guide 70 may be provided in the conductor guide 60 and the conductor 100 having the coiled portion 130 may be arranged in or to pass through the supplemental conductor guide 70. Alternatively, although not shown in the drawings, the conductor 100 having the coiled portion 130 may be directly arranged in or to pass through the rails 41 and 42 without the supplemental conductor guide 70 or the conductor guide 60. Further, it is possible that the conductor 100 having the coiled portion 130 may be arranged independently, not in any one of the rail 40, the conductor guide 60, or the supplemental conductor guide 70.

A third embodiment of the conductor 100 according to the present invention is shown in FIGS. 11 to 15B. Referring to the above drawings, the conductor 100 according to the third embodiment of the present invention is folded or unfolded according to the movement of the electrical device, e.g., the elevating device 30, or the movement of the door 13. In other words, the conductor 100 is retractable and extendable along a longitudinal direction thereof when the door 13 is closed or open. In this embodiment, a multiple jointed cover 80 through which the conductor 100 passes is provided to the refrigerator.

Figure 13:
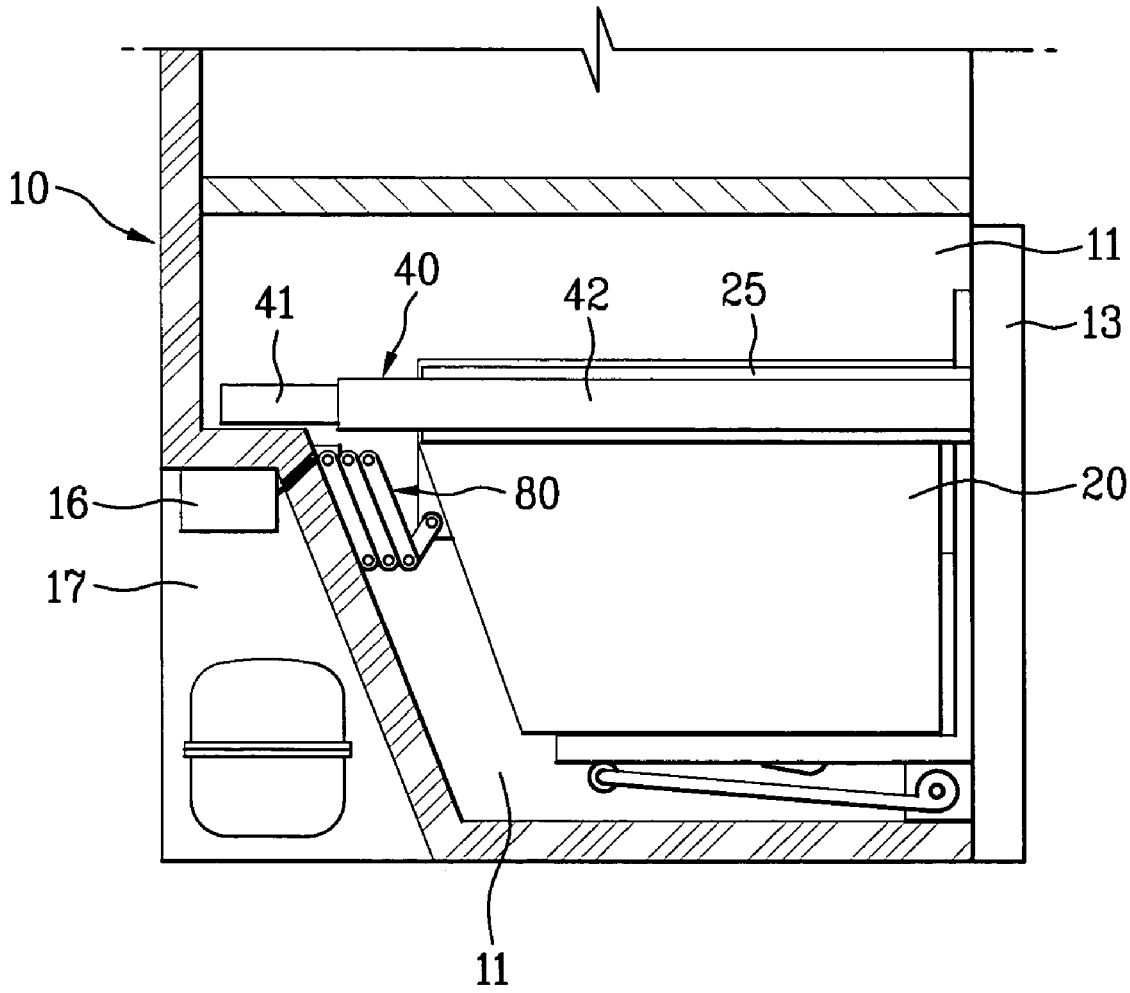
FIG. 13 illustrates a schematic cross-sectional view of the refrigerator shown in FIG. 11 for showing the conductor connection mechanism in accordance with the third embodiment of the present invention when the door is closed.
Figure 14:
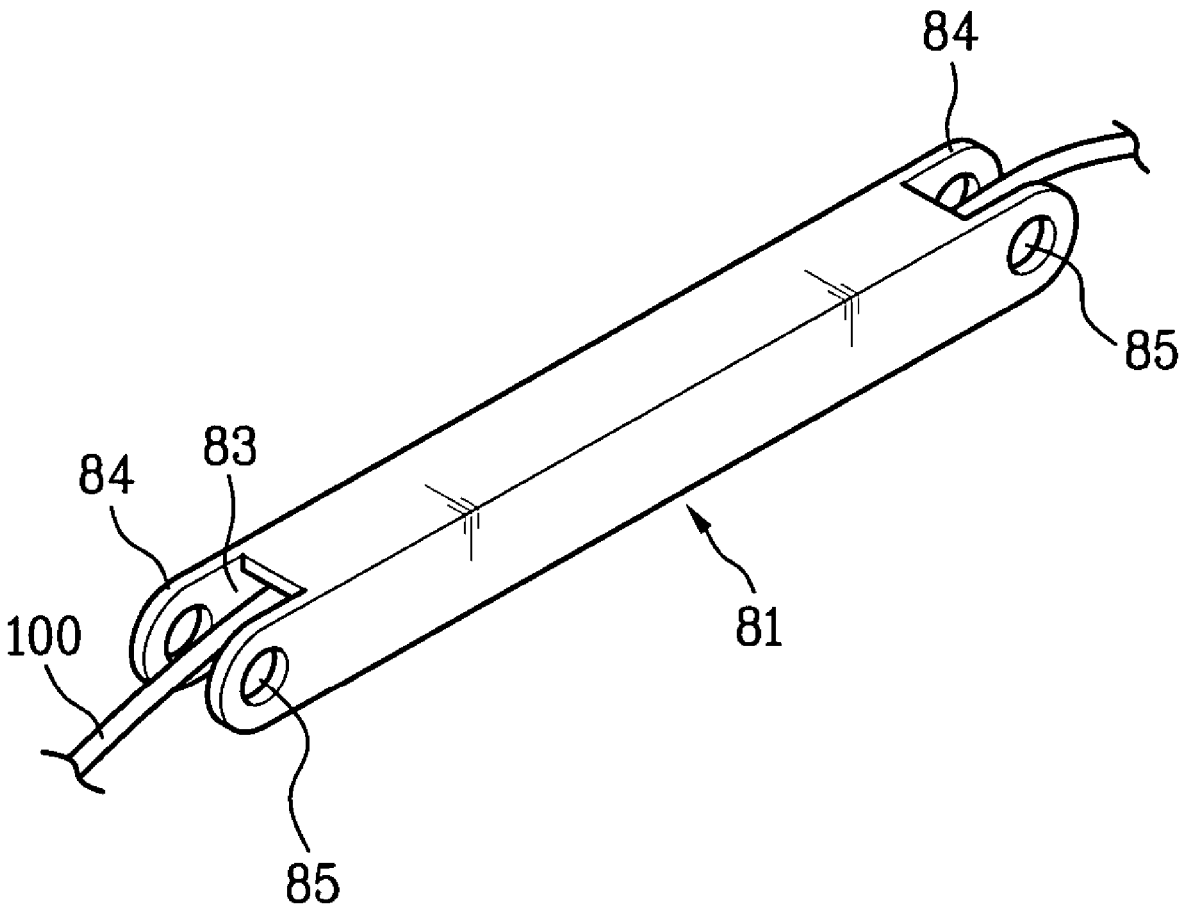
FIG. 14 illustrates a perspective view a segment of a jointed cover in accordance with the third embodiment of the present invention shown in FIGS. 11 through 13.

The foldable jointed cover 80 encompasses the conductor 100 so as to prevent the conductor 100 from being damaged by other parts of the refrigerator and from being touched by the user. In addition, the jointed cover 80 enables the conductor 100 to be folded or unfolded when the door 13 is open or closed as shown in FIGS. 12 and 13. Further, the jointed cover 80 prevents the conductor 100 from being slack by the gravity when the door 13 is open. The jointed cover 80 includes a plurality of segments 81 coupled with each other in series by pivots 87. FIG. 14 illustrates the segment 81 of the jointed cover 80 in detail. This embodiment will be described in detail referring to the FIG. 14.

The segment 81 of the jointed cover 80 has a hollow quadratic prism shape as shown in FIG. 14. A channel is provided in the segment 81 along a longitudinal direction of the segment 81. The conductor 100 is arranged to pass through the channel of the segment 81. The segment 81 has a pair of flanges 84 at both ends thereof. Two flanges 84 at the same end of the segment 81 are apart from and face each other. The conductor 100 which comes out of the channel of the segment 81 passes through a space between the flanges 84 at the ends of the segment 81. A hole 85 is provided on each flange 84 for a pivot 87 (shown in FIGS. 15A and 15B) to pass therethrough.

Figure 15A:
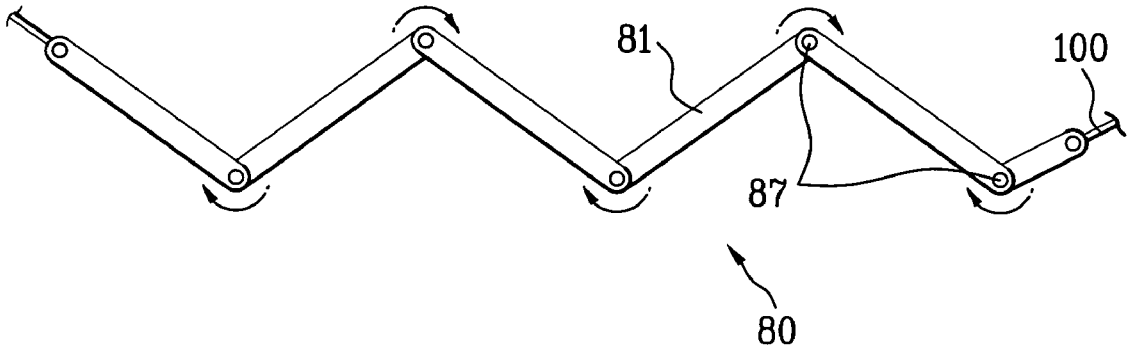
FIGS. 15A and 15B illustrate diagrams for showing the jointed cover when being extended and retracted, respectively.
Figure 15B:
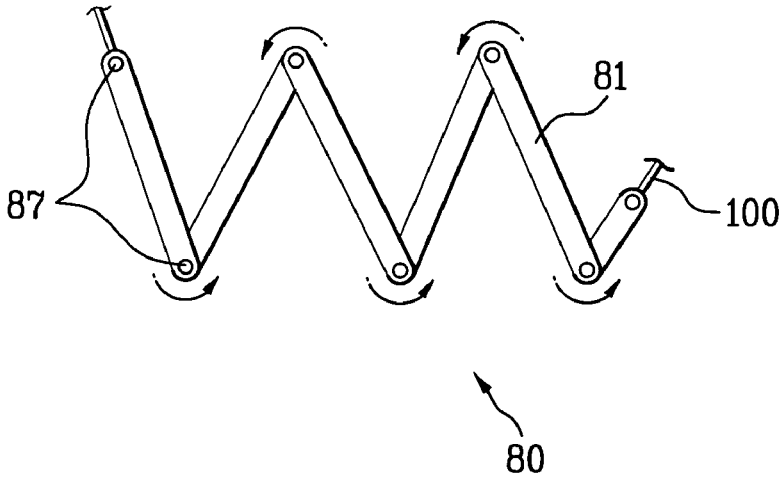

More particularly, a plurality of the segments 81 are arranged in series in a condition that the flanges 84 of two segments 81 adjacent to each other are overlapped. The pivot 87 is installed to pass through the holes 85 of the two adjacent segments 81 at the same time. Therefore, the segments 81 are jointed to each other. Since each segment 81 can rotate about each pivot 87, the multiple jointed cover 80 is folded and unfolded as shown in FIGS. 12 and 13, and 15A and 15B. In case that one segment of the jointed cover 80 rotates about a pivot in one of the clockwise and counterclockwise directions, the other segment of the jointed cover 80 adjacent to the one segment and sharing the same pivot may rotate about the pivot in the other one of the clockwise and counterclockwise directions as shown in FIGS. 15A and 15B.

In addition, a maximum interior angle, which can be formed between the two adjacent segments 81, may be limited. This is to prevent the jointed cover 80 encompassing the conductor 100 from being slack when the door 13 is fully open. In an embodiment, a protrusion or an extension (both not shown in the drawings) may be provided on the flange 84 or the segment 81 in order to limit the maximum angle between the two adjacent segments 81. Therefore, the jointed cover 80 may not be fully unfolded even if the door 13 is fully open as shown in FIG. 15A. However, it is possible that the jointed cover 80 is fully unfolded when the door 13 is fully open.

A first end of the jointed cover 80 is secured to the body 10 of the refrigerator and a second end of the jointed cover 80 is directly secured to the door 13. Alternatively, the second end of the jointed cover 80 is secured to a part firmly secured to and movable along with the door 13. More particularly, as shown in FIGS. 12 and 13, the bracket 25 firmly secured to the door 13 may be provided for the second rail 42 being secured thereto, and the second end of the jointed cover 80 may be secured to the bracket 25.

As has been described, the refrigerator according to the present invention has the following advantages.

The refrigerator according to the present invention provides an elevating device which enables the container in the compartment at the lower portion of the refrigerator to be elevated when the door is open. Therefore, it is not necessary that the user has to kneel down and bend over his or her body to take food from or put food into the container. Therefore, the refrigerator according to the present invention is very easy and convenient to be used.

In addition, the present invention provides a conductor extendable and retractable based upon the movement of the electrical device, e.g., the elevating device, or the movement of the door. Therefore, the present invention enables the conductor to electrically connect the body of the refrigerator with the electrical device or the door even if the electrical device or the door is movable forward and backward with respect to the body.

Further, the conductor according to the first through the third embodiments of the present invention is prevented from being slack even if the length of the conductor is maximized when the door is fully open. Therefore, the conductor is prevented from being damaged by other parts of the refrigerator.

Finally, the conductor according to the first through the third embodiments of the present invention may be encompassed by the rails for guiding the movement of the door, the (supplemental) conductor guide and the protection cover, or the jointed cover. Therefore, the conductor is protected with safety, and the user is protected from receiving an electric shock.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator, comprising:

a body;

a power source within the body;

a compartment within the body;

a container within the compartment, the container being moveable along a first direction;

an electrical device located on a door of the body, the electrical device moving along with the container in the first direction when the container moves along the first direction;

a conductor structurally configured to be electrically connected to the power source and the electrical device when the door is substantially at a fully open position to provide power from the power source to the electrical device when the door is substantially at the fully open position, and to be electrically disconnected to the power source and the electrical device when the door is at a fully closed position and when the door is not substantially at the fully open position, the conductor being extendable and retractable in the first direction when the electrical device moves along the first direction, wherein the conductor includes a first segment having a first terminal, and a second segment having a second terminal and movable with respect to the first segment in the first direction when the electrical device moves along the first direction;

a first conductor guide and a second conductor guide connected to the body and the door, the first segment being located on an inner side of a wall structure of the first conductor guide, the second segment being located on an outer side of a wall structure of the second conductor guide, the first terminal being located on an outer side of the wall structure of the first conductor guide, the second terminal being located on an inner side of the wall structure of the second conductor guide;

an electrical connection passing through the wall structure of the first conductor guide and electrically connecting the first terminal and the first segment; and an electrical connection passing through the wall structure of the second conductor guide and electrically connecting the second terminal and the second segment.

2. The refrigerator of claim 1, wherein the first direction is a horizontal direction.

3. The refrigerator of claim 1, wherein the first segment is electrically connected to the second segment when the door is substantially at the fully open position and electrically disconnected from the second segment when the door is at the fully closed position and when the door is not substantially at the fully open position.

4. The refrigerator of claim 3, wherein the first terminal is in contact with the second terminal at a space sandwiched between the first conductor guide and the second conductor guide when the door is substantially at the fully open position, and the first terminal is not in contact with the second terminal at a space sandwiched between the first conductor guide and the second conductor guide when the door is at the fully closed position and when the door is not substantially at the fully open position.

5. The refrigerator of claim 1, wherein the first and the second segments are overlappable with each other in the first direction to shorten a length of the conductor.

6. The refrigerator of claim 1, wherein the first segment is located at one of an inside and an outside of the first conductor guide, the second segment is located at an outside of the second conductor guide when the first segment is located at the inside of the first conductor guide, and the second segment is located at an inside of the second conductor guide when the first segment is located at the outside of the first conductor guide.

7. The refrigerator of claim 6, wherein the first terminal is located at one of the inside and outside of the first conductor guide opposite to the first segment, and the second terminal is located at one of the inside and outside of the second conductor guide opposite to the second segment.

8. The refrigerator of claim 6, further comprising a protection cover secured to at least one of the first and second conductor guides to cover and protect a part of the conductor exposed at the outside of the first and second conductor guides.

9. The refrigerator of claim 1, wherein the first conductor guide and the second conductor guide are further for guiding a movement of the container in the first direction.

10. The refrigerator of claim 1, further comprising a first rail and a second rail for guiding a movement of the container in the first direction.

11. The refrigerator of claim 1, wherein the second conductor guide movable with respect to the first conductor guide in the first direction when the electrical device moves along the first direction.

12. A refrigerator, comprising:

a body;

a power source within the body;

a compartment within the body;

a door coupled to the body for closing and opening the compartment;

an electrical device moving along with the door; and a conductor structurally configured to be electrically connected to the power source and the electrical device only when the door is substantially at a fully open position to provide power from the power source to the electrical device when the door is substantially at the fully open position, and to be electrically disconnected to the power source and the electrical device when the door is at a fully closed position and when the door is not substantially at the fully open position, the conductor being extendable and retractable in a longitudinal direction thereof when the door moves, wherein the conductor includes a first segment having a first terminal, and a second segment having a second terminal and movable with respect to the first segment in the first direction when the electrical device moves along the first direction;

a first conductor guide and a second conductor guide connected to the body and the door, the first segment being located on an inner side of a wall structure of the first conductor guide, the second segment being located on an outer side of a wall structure of the second conductor guide, the first terminal being located on an outer side of the wall structure of the first conductor guide, the second terminal being located on an inner side of the wall structure of the second conductor guide;

an electrical connection passing through the wall structure of the first conductor guide and electrically connecting the first terminal and the first segment; and an electrical connection passing through the wall structure of the second conductor guide and electrically connecting the second terminal and the second segment.

13. The refrigerator of claim 12, wherein the first segment is electrically connected to the second segment when the door is substantially at the fully open position and electrically disconnected from the second segment when the door is at the fully closed position and when the door is not substantially at the fully open position.

14. The refrigerator of claim 13, wherein one of the first conductor guide and the second conductor guide is inserted in the other one of the first conductor guide and the second conductor guide, the first terminal is in contact with the second terminal at a space sandwiched between the first conductor guide and the second conductor guide when the door is substantially at the fully open position, and the first terminal is not in contact with the second terminal at a space sandwiched between the first conductor guide and the second conductor guide when the door is at the fully closed position and when the door is not substantially at the fully open position.

* * * * *